US005803821A

United States Patent [19]

Lupinacci

[11] Patent Number: 5,803,821

[45] Date of Patent: Sep. 8, 1998

[54] GOLF CLUB GRIPPING AID AND METHOD OF MAKING SAME

[76] Inventor: Geno J. Lupinacci, 304 Westhill Rd., Stamford, Conn. 06902

[21] Appl. No.: 898,214

[22] Filed: Jul. 22, 1997

[51] Int. Cl.[6] ..... A63B 69/36; A41D 13/08

[52] U.S. Cl. ..... 473/205; 2/161.3; 473/60

[58] Field of Search ..... 473/205, 60, 59; 2/16, 20, 21, 161.2, 161.3, 161.4

[56] References Cited

U.S. PATENT DOCUMENTS

| | | | |
|---|---|---|---|
| 1,200,580 | 10/1916 | Brenner . | |
| 1,887,278 | 2/1932 | Auster . | |
| 2,244,445 | 11/1941 | Carson et al. . | |
| 2,277,893 | 3/1942 | Tweedie . | |
| 2,845,628 | 10/1958 | Dell . | |
| 2,867,814 | 1/1959 | Miles, Jr. . | |
| 3,178,724 | 4/1965 | Perschke | 473/205 X |
| 3,381,304 | 5/1968 | Coco . | |
| 3,896,498 | 7/1975 | Pang . | |
| 4,617,684 | 10/1986 | Green et al. . | |
| 4,754,499 | 7/1988 | Pirie . | |
| 4,977,621 | 12/1990 | Richard . | |
| 5,081,715 | 1/1992 | Mascia . | |
| 5,479,660 | 1/1996 | Najac . | |
| 5,603,679 | 2/1997 | Reis . | |

*Primary Examiner*—George J. Marlo
*Attorney, Agent, or Firm*—Parmelee & Bollinger, LLP

[57] ABSTRACT

A golf club gripping device with two separate but interconnected parts, the first being a main palm-engaging and initially flat but flexible component. The other component is a tongue-like flexible element secured by stitching at one end to the main component. The tongue-like element extends through an opening formed in the main component, and provides protection and gripping capability for portions of the hand beyond the main palm-engaging portion.

8 Claims, 6 Drawing Sheets

GOLF CLUB GRIPPING AID AND METHOD OF MAKING SAME

BACKGROUND OF THE INVENTION

1. Field of the Invention

This invention relates to hand-worn non-slip gripping devices providing protection for the hand from abrasive injury while manipulating an object such as a golf club. The range of use for this device can span the forceful swing of a common hammer, the dexterity of a pneumatic chisel, to the delicate touch of a golf club swing. In more detail, this invention relates to a flexibly resilient gripping device which extends across the palm of the hand and serves as a holding pad to enable the hand to close as a fist on the gripped object.

2. Description of the Prior Art

For quite some time, various devices have been used to protect hands from the physical effects of gripping an object while using it to apply force to another object. A common example is the use of a golf glove worn while gripping the club shaft as the stroke is made to hit the ball. Still other examples include gloves to assist in holding pneumatic chisels while forming pieces of marble or other hard material in artful fashion. Devices other than gloves have been suggested, but have not been successful in solving the problem of effecting a firm yet relaxed grip of a golf club or other generally cylindrical body to strike or otherwise apply force to an object.

It has been found that there are a number of important requirements that should be met for such a gripping device to be successful. Chief among these is the ability to absorb comfortably the jolt which is transmitted to the device upon impact with the object. Gloves are not satisfactory for a variety of reasons. They typically are quite confining, and tend to hold the hand rigidly while transmitting the shock directly through the glove to the hand, creating discomfort and distorting the smoothness and accuracy of a golf stroke.

SUMMARY OF THE INVENTION

In a preferred embodiment of the invention, to be described hereinbelow in detail, there is provided a hand-held gripping device suitable for use in holding the shaft of a golf club firmly and easily. This same device is able also to effect a non-slip grip of other objects such as pneumatic chisels, hammers and the like.

The device in its presently preferred form comprises two separate but interconnected parts, the first being a main palm-engaging and initially flat but flexible component. The other component is a tongue-like flexible element secured as by stitching at one end to the main component. The tongue-like element extends through a slit-like opening formed in the main component, and provides protection and gripping capability for portions of the hand beyond the main palm-engaging portion.

The device is in essence a holding pad comprising two specially shaped pieces of non-slip material. When assembled and secured together, these two pieces fold into the palm of the holding hand, allowing two stabilizing fingers to enter the device through the opening in the main component. When the total hand is fisted, the non-slip grip is activated.

The sizes of the two components of the device can be altered, without change in shape, to fit different sized hands, e.g., small, medium and large. A very important advantage of the disclosed construction is that the two components will be exactly the same for a right-handed as for a left-handed version, for a given size. The difference will be only in the manner of assembly of the two components, for right or left-handed versions.

There are a number of other important advantages resulting from the disclosed gripping device, as outlined below:

A. By forming the device from rubberized material, the non-slip characteristics of the device will in wet conditions be intensified—perhaps redoubled—whether swinging a golf club, hammering, or artistically operating a sculptor's pneumatic tool.

B. The slight elasticity of the device provides a snug and comfortable fit for either hand in use, whether left or right.

C. The ease of slipping the device on and off the hand offers the user a choice to wear the device only when needed—especially for a golfer.

D. The cost of construction of the device will be significantly lower than present gloves.

E. The full exposure to sunshine of the back of the holding hand, being covered so slightly, a suntan to the golfer is guaranteed to both hands equally.

F. Should the use of a rubberized material not be desired, the device can be made from a range of choices including leather, suedes, synthetics, etc.

G. Perhaps the greatest advantage to using this device by the better golfers is their freedom of fingers and wrist to "finesse" their golf magic around the green.

H. The device can be used over a full glove to provide enhanced comfort.

I. The device can be molded to required sizes, as by using a closed cell neoprene base material or equal.

J. The wearing of rings presents no problem with this device as compared with a regular glove.

K. Wearing this device does not hamper the visibility of any jewelry being worn (rings or wrist watch).

The device disclosed herein is particularly advantageous for use by two categories of golfers, as follows:

Senior Golfers:

This class of golfer has continued the game of golf until it "hurts", i.e., elder golfers who have stayed with the game until they begin to sense the creeping jolts of arthritic pain, while wielding a golf club. This group of seniors typically continue to wear a golf glove, adjusted to the snuggest fit possible. Experience has indicated however that if the holding hand is encased in such a close-fitted glove, the intensity of these arthritic jolts is magnified—causing a subconscious flinch, not conducive to a finished, smooth golf swing.

The disclosed device, when worn, confines no part of the holding hand. The hand senses a soft cushioned feel that acts to absorb the jarring, and thus softens the jolt to aching joints.

Beginner Golfers:

Golf instructors for beginning pupils dwell constantly on the importance of a relaxed, non-pressured grip of the dominant hand on the golf club shaft. Through whatever manner the beginner acquires a golf glove, she or he commonly is instructed to select a glove that has the snuggest fit to their hand size. The snugness of this fit negates the precautions given by the instructor about a relaxed non-pressured grip on the club shaft, and the hand that closes on the club shaft becomes more "primed" to "throw a punch" rather than to execute a golf swing effortlessly. With all muscles tense, the beginner is introduced to the greatest destroyer of a golf swing, blocking the possibility of the elusive desired swinging motion.

However, if the beginning pupil started to learn while fitted to the device of the invention, instead of a snug glove, there would not be a need for a tense muscle in either arm.

This device with its soft cushioned feel, and no-slipping squeeze will relax the beginner as instructed, to the finish of the golf swing, with all muscles staying loose.

Other objects, aspects and advantages of the invention will in part be pointed out in, and in part apparent from, the following description considered together with the accompanying drawings.

DETAILED DESCRIPTION OF A PREFERRED EMBODIMENT

Figure 1:
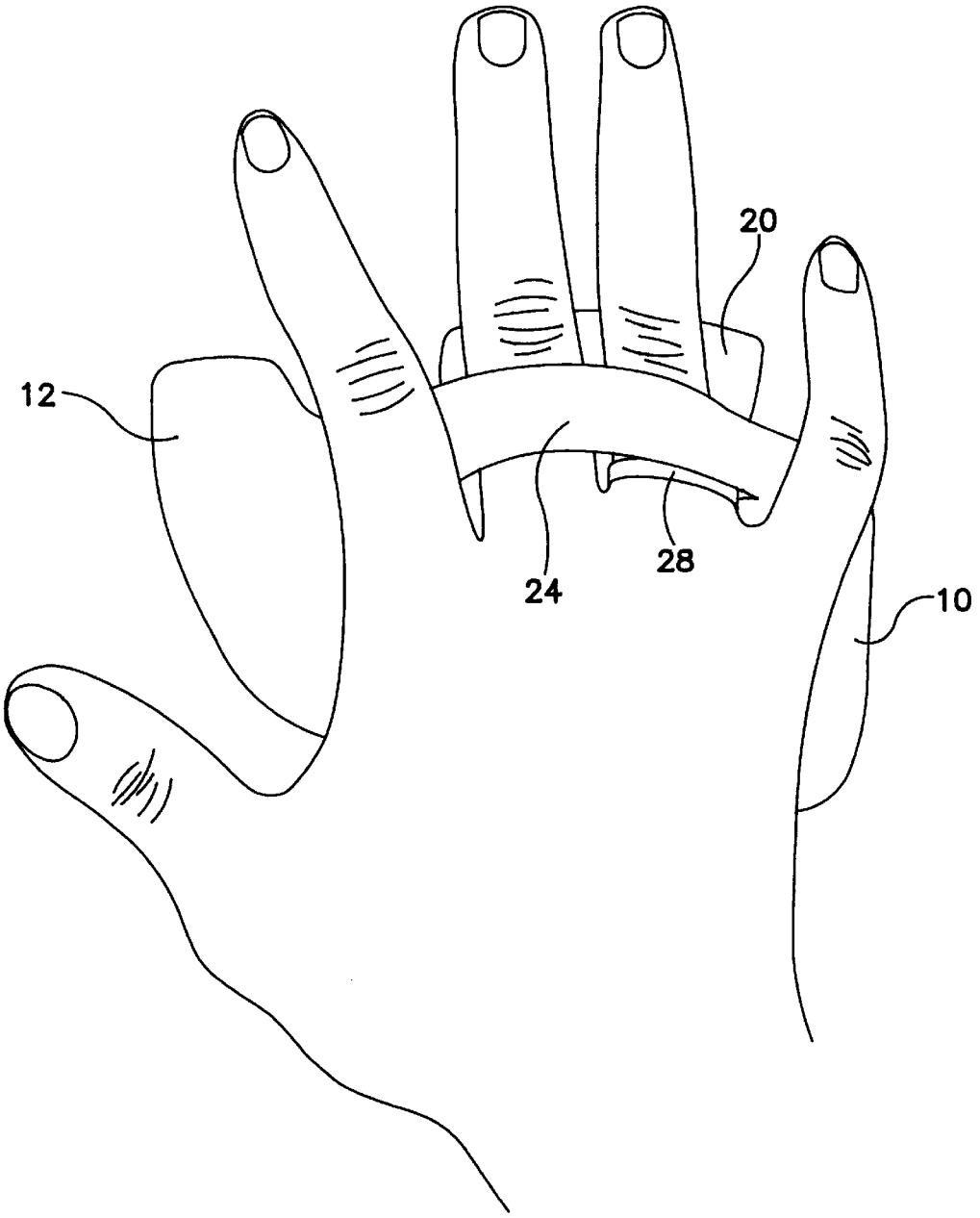
FIG. 1 is a pictorial view of a preferred embodiment of the invention of FIG. 1, as seen from the back of the hand carrying the device.
Figure 2:
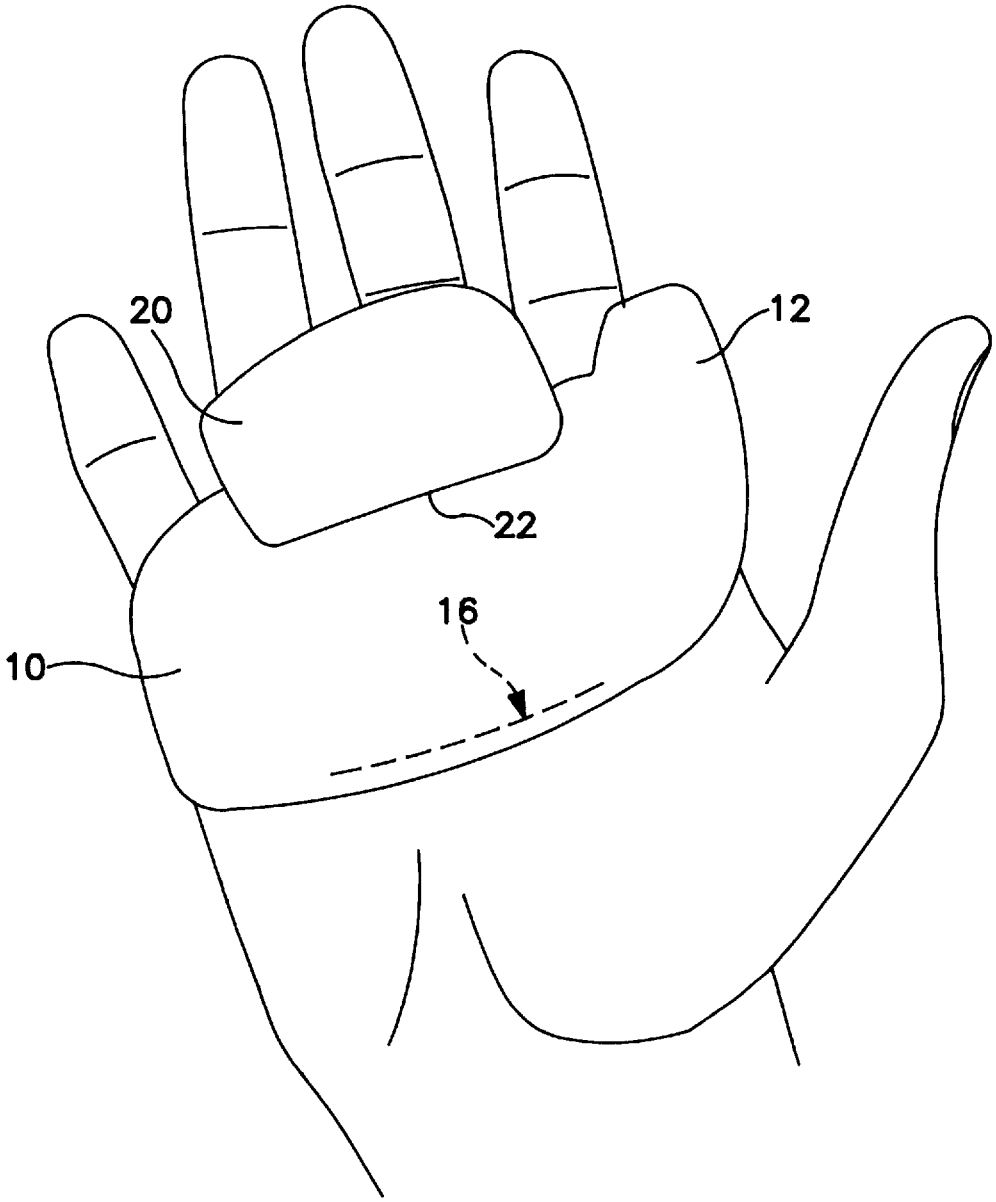
FIG. 2 is a pictorial view of the preferred embodiment of the invention as seen looking towards the palm of a person's right hand.
Figure 3:
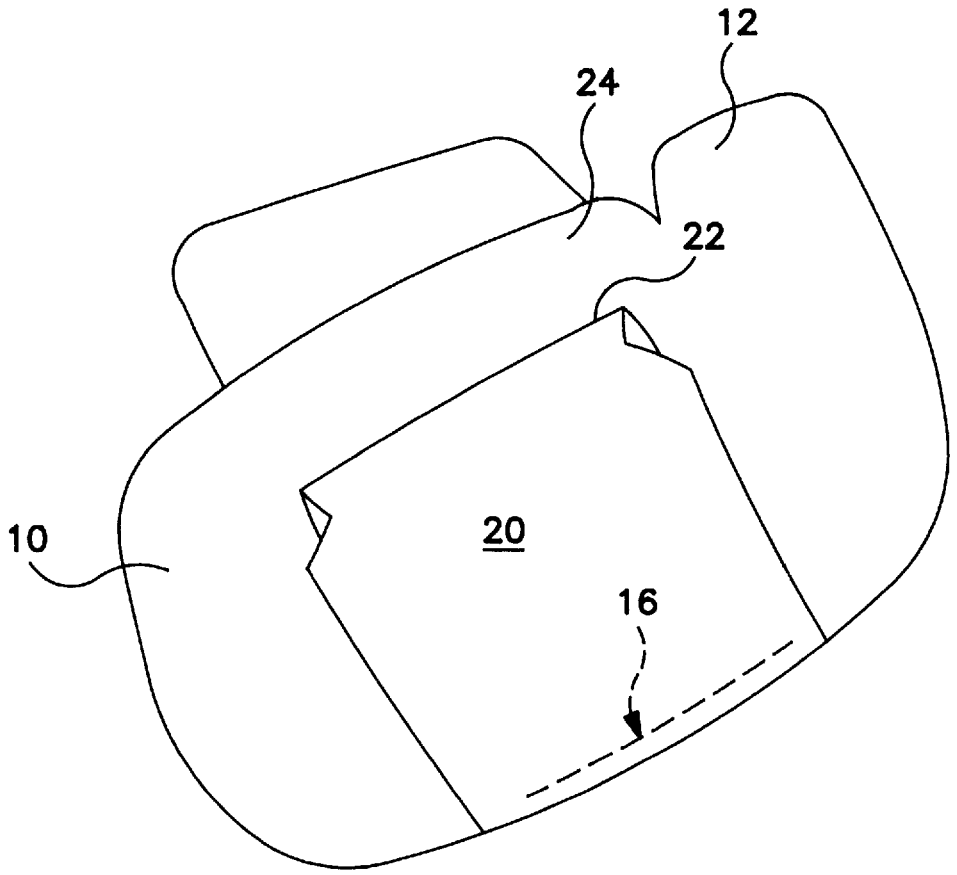
FIG. 3 is a view of the device free of the hand, but seen from the same side as shown in FIG. 1.

Referring now to FIGS. 1–3, the gripping device comprises a main palm-engaging component 10 made from a thin sheet of rubberized material such as neoprene. This component is shaped to match approximately the outlines of the wearer's palm, and includes an extension portion 12 opposite the thumb. In use, the upper edge of the main component may lie just short of the level of the second joints of the two central fingers.

Secured as by stitching along a line 16 (FIG. 2) in the lower region of the palm component, is a second component 20 which is somewhat tongue-like in shape. This component may be made of the same material as the palm component, and extends into and through a slit-like opening 22 formed in the palm component. This tongue-like second component extends up towards the tips of the fingers, and its upper edge may be slightly beyond the second joints of the two central fingers.

The opening 22 is parallel to the edge of the main component 10 and defines a narrow strip of material 24 along that edge. When the device is in use, this strip (see particularly FIG. 1) is flexed away from the remainder of the main component to form a space for insertion of the two central fingers of the hand, thereby to secure the gripping device in place on the hand. FIG. 1 also shows how the device makes it possible to wear jewelry, such as a ring 28, without interference, and having the fingers free to move easily to hold an object.

FIG. 3 shows the device of this invention when not in use. As shown, the second component 20 is stitched to the main component 10 along a line 16, and extends through the opening 22 to a position beneath the strip 24. The strip can be flexed upwardly, away from the component 20 so as to create space for insertion of two stabilizing fingers between those elements.

Figure 4A:
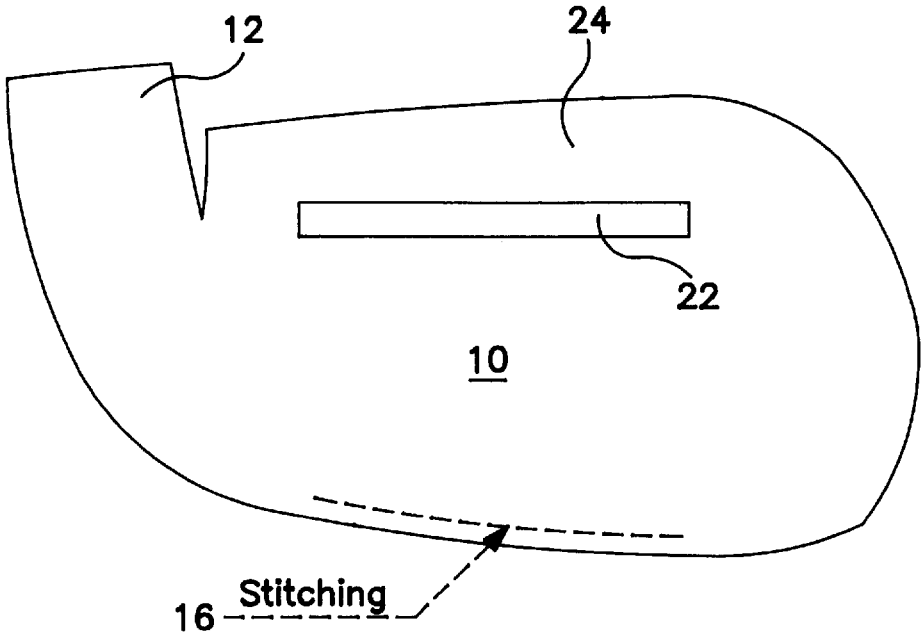
FIGS. 4A and 4B are plan views of the two components from which the device is assembled.
Figure 4B:
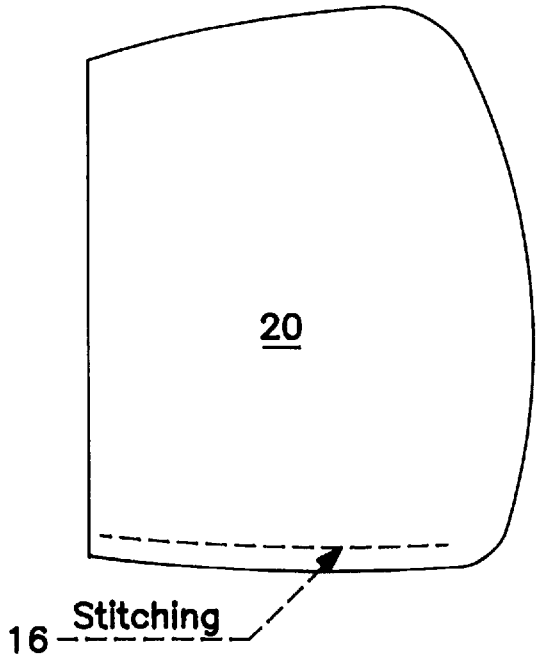

FIGS. 4A and 4B together show the two components 10 and 20 of the device before assembly. The two components are stitched together along the line 16. Alternatively, the two components can be molded as an integral unitary device.

Figure 5:
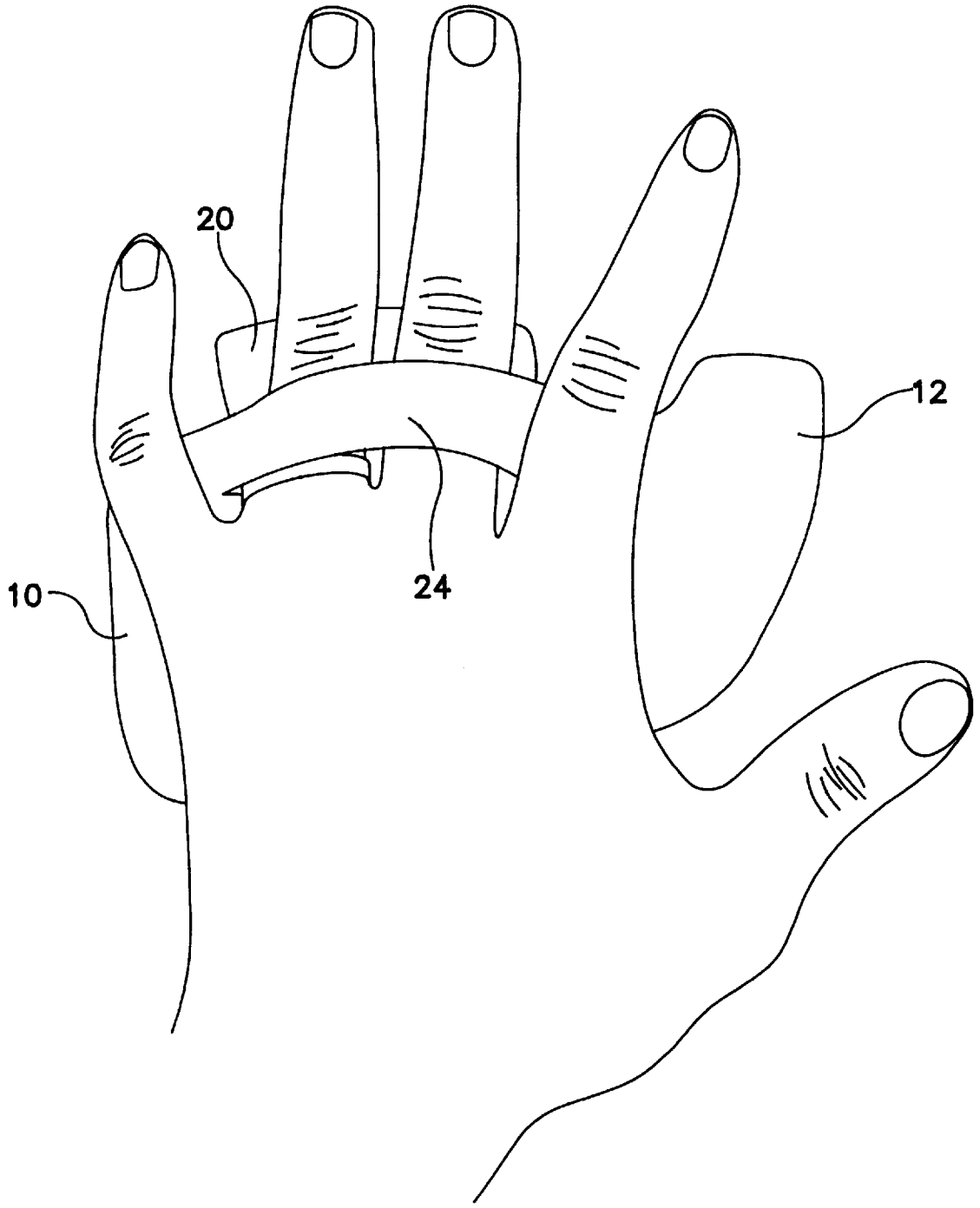
FIG. 5 is a view like that of FIG. 1 but with a device of the invention worn on the left hand of the user.
Figure 6:
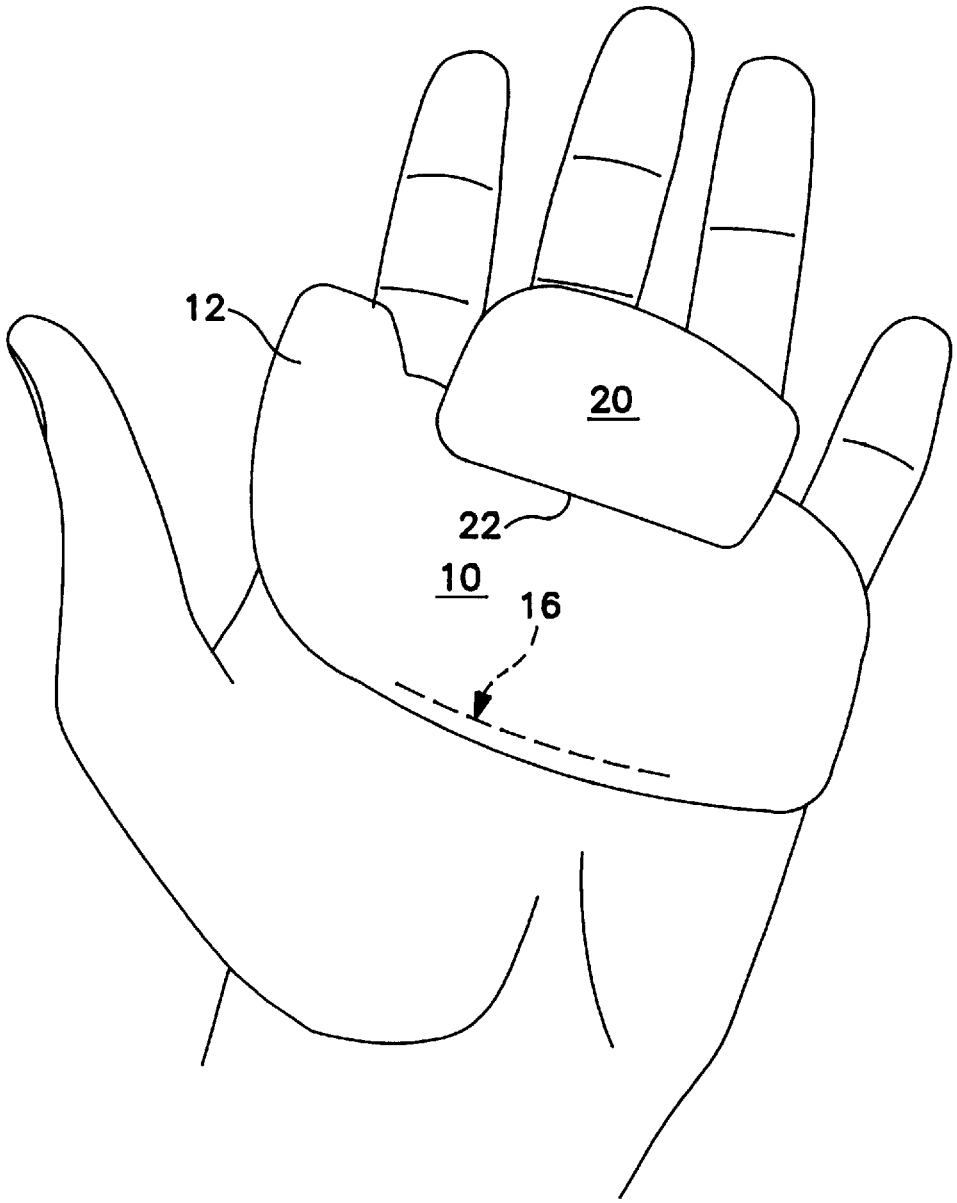
FIG. 6 is a view of the device of FIG. 5 as seen looking towards the palm of the hand.

FIGS. 5 and 6 show the device in use on a person's left hand. Devices can if desired be used with advantage on both hands to provide full protection with comfort of action.

It should be noted that there is a large segment of people who resent wearing gloves of any kind. The apparatus proposed in this patent application offers an alternative choice which should be presented to them for consideration.

Although a preferred embodiment of the invention has been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. A hand-held device for use in gripping the shaft of a golf club, comprising:

a main component in the form of a sheet of flexible material shaped to fit protectively over at least part of the palm of a person's hand;

said main component being formed with an opening extending in a direction generally transverse to the fingers of the hand; and an ancillary component having a tongue-like shape secured at one end to and extending away from the side of said main component which is to face the palm of the hand;

said ancillary component extending through said opening in a direction towards the tips of the fingers and providing space for fingers of the hand to fit in between the ancillary component and a part of the main component adjacent said opening so as to hold said device in place on the hand while gripping an object.

2. A device as in claim 1, wherein said flexible material is a rubberized fabric providing resilience and elasticity.

3. A device as in claim 1, wherein said main component and said ancillary component are molded together to form an integral device.

4. A device as in claim 1, wherein said flexible material is a non-rubberized material.

5. The method of forming a hand-held gripping device for holding the shaft of a golf club, comprising the steps of:

forming a sheet of thin flexible material to a shape having an outline suited for covering at least part of the palm of the gripping hand;

forming an elongate opening in said sheet of material extending in a direction generally transverse to the direction of finger extension when the device is in place;

securing a tongue-like element to said sheet of material on the side thereof intended to face the palm of the hand; and inserting said tongue-like element through said opening;

whereby fingers of the holder's hand can be inserted into the space between the tongue-like component and the main component to secure the device to the holder's hand.

6. The method of claim 5, wherein said material is resilient.

7. The method of claim 6, wherein said material is a rubberized fabric.

8. The method of claim 5, wherein said material is a non-rubberized fabric.

* * * * *